US005429472A

United States Patent [19]

Dahl

[11] Patent Number: 5,429,472

[45] Date of Patent: Jul. 4, 1995

[54] MECHANISM FOR LIFTING HAULING OF A CONTAINER

[76] Inventor: Harald Dahl, Utsikten 9, N-2390 Moelv, Norway

[21] Appl. No.: 107,782

[22] PCT Filed: Dec. 22, 1992

[86] PCT No.: PCT/NO92/00203

§ 371 Date: Nov. 23, 1993

§ 102(e) Date: Nov. 23, 1993

[87] PCT Pub. No.: WO93/12996

PCT Pub. Date: Aug. 7, 1993

[30] Foreign Application Priority Data

Dec. 23, 1991 [NO] Norway ..... 915086

[51] Int. Cl.[6] ..... B60P 1/04; B62B 1/06

[52] U.S. Cl. ..... 414/444; 254/8 R; 280/43.1; 280/43.23; 280/43.24; 280/47.131; 280/418.1; 414/490

[58] Field of Search ..... 280/19, 24, 47.131, 280/43.1, 43.23, 43.24, 493, 418.1; 414/444, 490; 254/8 R, 8 B, 45

[56] References Cited

U.S. PATENT DOCUMENTS

| | | | |
|---|---|---|---|
| 2,010,490 | 8/1935 | Jones | 254/8 R |
| 3,257,018 | 6/1966 | Miles | 414/444 |
| 3,378,276 | 4/1968 | Fulmer | 280/43.23 |
| 3,423,101 | 1/1969 | Boeye | 280/43.23 |
| 3,512,755 | 5/1970 | Donakowski | 254/8 R |
| 3,570,694 | 3/1971 | Tantlinger | 280/43.23 |
| 3,779,571 | 12/1973 | Ahmling . | |
| 4,114,941 | 9/1978 | Heaton . | |
| 4,231,709 | 11/1980 | Corsetti | 280/43.23 |
| 4,452,555 | 6/1984 | Calabro | 280/43.23 |
| 4,936,733 | 6/1990 | Girerd . | |
| 4,940,252 | 7/1990 | Seib . | |

FOREIGN PATENT DOCUMENTS

| | | |
|---|---|---|
| 4133816 | 4/1992 | Germany . |
| 91/09792 | 7/1991 | WIPO . |

*Primary Examiner*—Mitchell J. Hill
*Attorney, Agent, or Firm*—Bacon & Thomas

[57] ABSTRACT

A mechanism for lifting and hauling of a container or the like onto or from a ramp, a tipping body of a lorry and to or from a location which is not easily accessible for heavy haulage vehicles and/or heavy lifting gear includes a hauling arm secured intermediate first and second ends of a shaft and levering arms also attached to the shaft. The shaft is pivotably connected to locking elements adapted to be secured to lower corners of the container at one end thereof. With this arrangement, when the locking elements are secured to the container and the hauling arm is manipulated in order to rotate the shaft relative to the locking elements, the levering arms engage a supporting surface for the container and continued rotation of the shaft causes at least a portion of the container to be lifted from the supporting surface for hauling of the container.

5 Claims, 1 Drawing Sheet

MECHANISM FOR LIFTING HAULING OF A CONTAINER

BACKGROUND OF THE INVENTION

1. Field of the invention

The present invention relates to a mechanism for lifting and/or hauling of a container.

2. Discussion of the Prior Art

Containers and similar loading bodies, including loading pallets, are increasingly used for transport and storage of various goods. This use is, however, of restricted value in locations having reduced accessibility for lifting and transporting units because it may be difficult to deliver and remove the container from such locations using the normal container removal vehicles.

SUMMARY OF THE INVENTION

It is an object of the present invention to overcome this difficulty and to permit the transportation and storage of a container even in locations where such transport and storage was not heretobefore convenient.

Thus, the invention aims at a mechanism for lifting and hauling of a container or the like, by means of which the container may be elevated above the ground and subsequently hauled onto e.g. a ramp or a tipping body of a lorry by means of a simple hauling mechanism and without the use of special lifting gear. Alternatively, the ramp or the tipping body may be moved in under the container body.

These and other objects of the invention are achieved by providing a lifting and hauling mechanism comprising a pivotable assembly of arms which are attached at spaced circumferential positions about a shaft and a locking arrangement for securing the shaft to the lower corners at one end of the container or the like.

Further features of the invention will be apparent from the following detailed description, reference being made to the accompanying drawing showing an embodiment by way of example.

DETAILED DESCRIPTION OF THE PREFERRED EMBODIMENT

Figure 1:
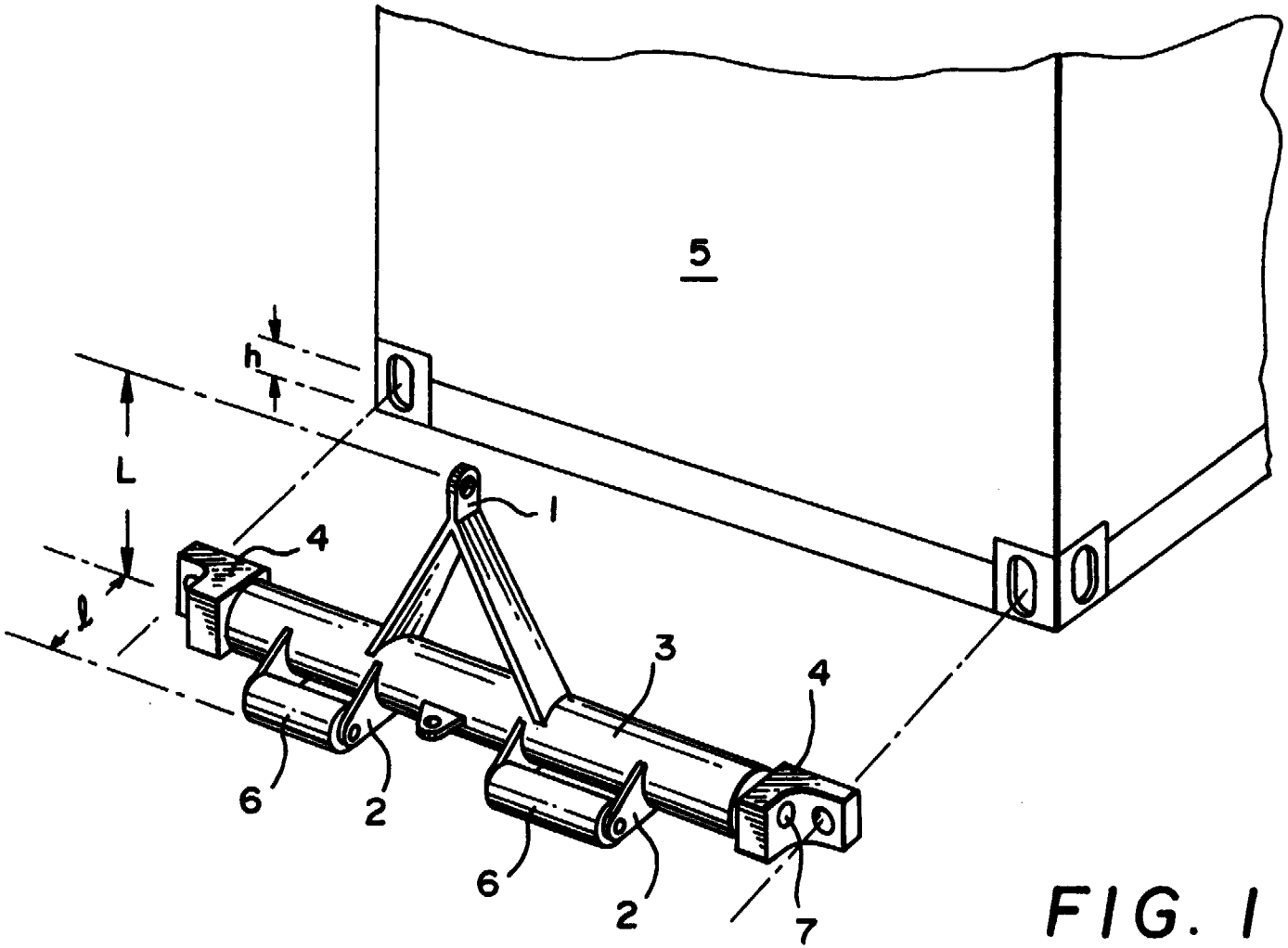
FIG. 1 is a perspective view of the lifting and hauling mechanism of the invention and illustrates its attachment to a container.

FIG. 1 depicts the lifting and hauling mechanism according to the preferred embodiment comprising a pivotable system of arms 1, 2 which are attached to a shaft 3 and extend in radial directions with respect to an outer circumferential surface of shaft 3. Further, the mechanism is provided with locking elements 4 to rotatably attach the shaft 3 to the lower corners at one end of a container 5 or a similar loading body. The locking elements 4 may be of the type known for locking containers and the like to the decks of ships, etc.

The arm system comprises a first arm 1 located at midlength of the shaft 3 and intended to be connected to a winch of similar hauling mechanism by means of a wire or the like. Hereinafter, arm 1 shall be referred to as a "hauling arm". The arm system further comprises one or more arms 2, there being two such further arms 2 in the embodiment shown. These further arms 2 will, when the hauling arm 1 is rotated under the influence of the hauling mechanism, be pivoted to the ground, thereby lifting the container end from the ground through a levering action. These further arms 2 shall consequently be referred to as "levering arms".

The shaft 3 is pivotably connected to the locking elements 4 by means of pivot pins 7. In an alternative embodiment the shaft means may be in the form of a hollow shaft journalled on pivot pins extending from each locking element or on a rod extending from one locking element 4 to the other.

In the mounted non-active state of the mechanism of the invention, the hauling arm 1 extends substantially vertically upward while the levering arm(s) 2 extend forward and downward from the container 5. The length L of the hauling arm 1 is preferably greater than the length $\lambda$ of the levering arm(s) 2 in order to provide a required moment to lift the container from the ground. The mechanism of the invention is mounted on the container with such a height h of the center line of the shaft 3 above the underside of the container bottom and with respect to the levering arm length $\lambda$ that the levering arm 3 may cause a lifting of the container end a distance $\lambda$- h sufficiently to allow the container end to be hauled directly onto the end of a ramp or a tilted tipping body.

The levering arm(s) 2 are conveniently provided with a roller 6 or the like at its free end, in order to allow the container 5 to be hauled along the ground or in order to allow a ramp or a tilted tipping body to be removed in under the container end once the container is levered from the ground.

The mechanism of the invention may alternatively be provided with skids or the like at the free ends of the levering arms 2.

Independently of whether the levering arms (2) carry rollers (6) or skids at their free ends, the mechanism of the invention may be advantageously used for shifting containers from one location to another in regions which are not easily accessible with heavy haulage vehicles and/or heavy lifting gear. The mechanism may also advantageously be used for releasing a container or the like which is frozen or stuck to the ground.

I claim:

1. A mechanism for lifting and hauling a container comprising:

an elongated shaft having first and second longitudinally spaced ends and a circumferential surface;

first and second locking elements;

means for rotatably attaching the first and second ends of said shaft to said first and second locking elements respectively;

a first arm assembly fixedly secured, in a first attachment zone, to said shaft and extending radially from the circumferential surface thereof; and a second arm assembly fixedly secured, in a second attachment zone, to said shaft and extending radially from the circumferential surface thereof, said second attachment zone being circumferentially spaced about the circumferential surface of said shaft from said first attachment zone, wherein, when said first and second locking elements are secured to a lower portion of a container and said first arm assembly is manipulated in order to rotate said shaft relative to said first and second locking elements, said second arm assembly is caused to engage a supporting surface for the container and continued rotating of said shaft enables the second arm assembly to be positioned substantially directly below said shaft and at least a portion of the container to be lifted from the supporting surface for hauling of the container.

2. The mechanism according to claim 1, wherein said first attachment zone is located centrally between the first and second ends of said shaft.

3. The mechanism according to claim 1, wherein said first arm assembly extends radially from the circumferential surface of said shaft a distance greater than said second arm assembly.

4. The mechanism according to claim 1, wherein said second arm assembly includes first and second arm units extending from said shaft at spaced longitudinal locations.

5. The mechanism according to claim 1, wherein said second arm assembly includes a roller carried by a free end of said second arm assembly at a location spaced from said shaft.

* * * * *